US006019884A

United States Patent [19]

Kiyama et al.

[11] Patent Number: 6,019,884

[45] Date of Patent: Feb. 1, 2000

[54] METHOD OF CORRECTING WARPAGE OF STEEL STRIP IN ELECTROPLATING LINE

[75] Inventors: Shuji Kiyama; Makoto Imamura; Osamu Shin; Naoki Sakai; Shinjiro Murakami, all of Kurashiki, Japan

[73] Assignee: Kawasaki Steel Corporation, Kobe, Japan

[21] Appl. No.: 08/952,283

[22] PCT Filed: Mar. 25, 1997

[86] PCT No.: PCT/JP97/00988

§ 371 Date: Dec. 1, 1997

§ 102(e) Date: Dec. 1, 1997

[87] PCT Pub. No.: WO97/37063

PCT Pub. Date: Sep. 10, 1997

[30] Foreign Application Priority Data

Mar. 29, 1996 [JP] Japan ..... 8-077733
Jun. 17, 1996 [JP] Japan ..... 8-155602

[51] Int. Cl.[7] ..... C25D 7/06

[52] U.S. Cl. ..... 205/138; 205/152

[58] Field of Search ..... 205/138, 149, 205/152

[56] References Cited

FOREIGN PATENT DOCUMENTS 59-153379 10/1984 Japan .
3-126890 5/1991 Japan .
5-125588 5/1993 Japan .

*Primary Examiner*—Edna Wong
*Attorney, Agent, or Firm*—Oliff & Berridge, PLC

[57] ABSTRACT

The present invention provides a method of correcting warpage of a steel strip caused by a current-carrying roll and an opposite backup roll, which hold the steel strip therebetween, in a horizontal electroplating line, wherein the opposite backup roll is formed to be smaller than the current-carrying roll, and the backup roll is offset relatively to the opposite current-carrying roll in the movement direction of the steel strip by a constant value predetermined according to operation conditions. The offset amount is preferably within the range of 5 to 35 mm.

1 Claim, 7 Drawing Sheets

METHOD OF CORRECTING WARPAGE OF STEEL STRIP IN ELECTROPLATING LINE

This is anatomy stage application of PCT/JP97/00988 filed Mar. 25, 1997.

TECHNICAL FIELD

The present invention relates to a method of producing an electroplated steel sheet, and particularly to a method of correcting warpage of a steel strip in an electroplating line.

BACKGROUND ART

In a horizontal electroplating line, generally, plural pairs of backup rolls and current-carrying rolls are provided, and horizontal electrodes are disposed above and below a steel strip between the respective two current-carrying rolls to electroplate the steel strip while supplying electricity. In general, each of the current-carrying rolls comprises an iron roll, and each of the backup rolls comprises a rubber roll. In this case, the surfaces of the rubber rolls are concavely deformed due to a difference in hardness between iron and rubber, thereby bending the steel strip along deformation. For example, when an iron roll is provided on the upper side, and a rubber roll is provided on the lower side, the steel strip is bent concavely upward, and pulled by tensile force to produce warpage of the steel strip in the width direction thereof. Warpage of the steel strip causes problems of nonuniformity in plating, etc.

As techniques for correcting warpage of a steel strip in the horizontal electroplating line, Japanese Patent Unexamined Publication No. 3-126890 discloses a technique in which widthwise warpage deformation of a steel strip is constantly detected in a plating bath, and backup rolls are shifted in the pass direction of the steel strip while maintaining the predetermined pressure on current-carrying rolls on the basis of the detection signal, to correct widthwise warpage of the steel strip.

The method comprising shifting the backup rolls according to the warpage amount of the steel strip has a problem in that it is very difficult to shift the backup rolls in the direction of movement of the steel strip while maintaining the predetermined pressure on the current-carrying rolls. In addition, when the backup rolls are shifted under supply of electricity, a spark occurred on a gap which is generated between the current-carrying rolls and the steel strip, thereby causing the problem of damaging the surfaces of the steel strip and the current-carrying rolls. This technique also has a problem in that when the steel strip significantly warps, the shift amount of the backup rolls is increased, and thus the pass line of the steel strip significantly changes, thereby causing a difference between the amounts of the deposits on the face and back of the steel strip.

An object of the present invention is to provide a method of correcting warpage of a steel strip in an electroplating line in which the above-described drawbacks are improved.

DISCLOSURE OF THE INVENTION

The present invention has been developed for solving the above problems, and provides a method of correcting warpage of a steel strip in a horizontal electroplating line comprising current-carrying rolls and backup rolls with a steel strip held therebetween, the method comprising forming at least one of the backup rolls so that the backup roll is smaller than the opposite current-carrying roll, and arranging the rolls so that the backup roll is shifted (simply referred to as "offset" hereinafter) relatively to the opposite current-carrying roll in the movement direction of the steel strip. In this case, the offset amount is preferably within the range of 5 to 35 mm.

The criterion of offset is in a state where the line connecting the center of the backup roll diameter and the center of the opposite current-carrying roll diameter is perpendicular to the pass line of the steel strip, as shown in FIG. 2. In this state, the offset amount is considered as zero.

An operation of the present invention is as follows. If a backup roll is offset relatively to an opposite current-carrying roll in the movement direction of the steel strip, the steel strip passed through the current-carrying roll is wound around the backup roll and thus rebent in the direction reverse to bending by the current-carrying roll, thereby relieving residual bending stress. If the offset amount is increased, the effect of correcting warpage is increased, but the steel strip is moved upward from the pass line in the portions of contact with the current-carrying roll, and thus the position of the steel strip is changed. Therefore, the backup roll diameter is made smaller than the current-carrying roll diameter to improve the warpage correcting effect and keep the offset amount in a low level.

It was also found that when each of the backup rolls is formed to be smaller than the opposite current-carrying roll, and is offset relatively to the current-carrying roll by an amount within the range of 5 to 35 mm in the movement direction of the steel strip, it is possible to desirably correct warpage of the steel strip.

Offset may be achieved by moving the backup roll forward relatively to the opposite current-carrying roll in the movement direction of the steel strip. This may also be achieved by moving the backup roll forward, moving the opposite current-carrying roll backward or by both methods.

The offset amount can be properly determined according to the conditions such as the thickness, width, mechanical property and yield stress of the steel strip, arrangement and the sizes of the current-carrying rolls and the backup rolls, a difference in hardness therebetween, etc., as described below. With a small offset amount, the backup roll has the low function to rebend the steel strip and a small effect. With an excessive offset amount, the pass line of the steel strip is moved upward or downward, thereby causing a difference between the deposits on the face and back of the steel strip. Therefore, the offset amount is preferably within the range of 5 mm to 35 mm, which makes it possible to suppress a change in the pass line of the steel strip. Alternatively, the offset amounts of a plurality of backup rolls may be set to different values.

In the present invention, the diameter of a backup roll is preferably 0.50 to 0.97D relative to the diameter D of an opposite current-carrying roll. If the diameter of the backup roll exceeds 0.97D, the offset amount must be increased, and the diameter reduction is meaningless. If the diameter of the backup roll is less than 0.50D, the offset backup roll undesirably has only a little force to hold the steel strip. Although the diameter of the backup roll depends upon other conditions, the diameter is preferably about 0.80D.

Although the offset amount is also affected by other operation conditions, the inventors determined the relations of the offset amount d (mm) required for minimizing ($\approx 0$) warpage of the steel strip to the thickness t (mm) of the steel strip, yield stress $\sigma_e$ (kgf/mm$^2$), tensile force $\sigma_T$ (kgf/mm$^2$), the diameter $L_1$ of the current-carrying roll, and the diameter $L_2$ of the backup roll. As a result, it was found that the offset amount d is represented by the following relation expression. These values have previously been given as tracking information and equipment information.

$$d = \left\{ \frac{L_1 - L_2}{2K} \left( \frac{2}{L_2} \right)^{0.28} + \left( \frac{1}{a} \cdot \frac{L_1}{L_2} \right)^{0.28} \right\}^{-1/0.28} \quad (1)$$

wherein $$K = 2t \cdot \frac{215.6}{1 + (\sigma_T / 2\sigma_e)}$$

t: thickness of the steel strip passed (mm)

$\sigma_T$: tensile force of the steel strip passed (kgf/mm$^2$)

$\sigma_e$: yield stress of the steel strip passed (kgf/mm$^2$)

$L_1$: diameter of the current-carrying roll (mm)

$L_2$: diameter of the backup roll (mm)

a is a value determined by the hardness and pressure of the current-carrying roll and the opposite backup roll, and can be determined by measuring the nip width between both rolls.

$$a\ (L_1\theta_1)/2$$

In the present invention, in order to solve the above problems, the optimum offset amount d is determined so that the warpage of the steel strip is zero according to equation (1), and the backup roll or the current-carrying roll has previously been offset by an amount d so that warpage of the steel strip can be corrected without occurrence of spark flaws due to inferior contact between the current-carrying roll and the steel strip.

Generally, when warpage of the steel strip is corrected by a leveler, the familiar experimental equation (Misaka's equation) between a roll and a sheet is used.

$$\rho = \frac{L}{2} + 2t\left( \frac{215.6}{1 + (\sigma_T / 2\sigma_e)} \cdot \frac{1}{\theta^{0.28}} - 243.2 \right) \quad (2)$$

wherein

ρ: working radius of curvature

L: roll diameter t: sheet thickness $\sigma_T$: tensile force $\sigma_e$: yield stress of the steel strip θ: winding angle Warpage of the steel strip is due to the fact that the surface of the rubber roll is concavely deformed due to a difference in hardness between the current-carrying roll and the opposite backup roll, and thus the steel strip is bent concavely upward. The amount of warpage can be controlled by controlling the amount of bending of the steel strip, i.e., the working radius of curvature. Therefore, in order to make the warpage of the steel strip zero after passing through the current-carrying roll, the working radius of curvature $\rho_1$ due to a difference in hardness between the current-carrying roll and the opposite backup roll may be equal to the working radius of curvature $\rho_2$ due to offset of the backup roll.

If the diameter of the current-carrying roll is $L_1$, the diameter of the backup roll is $L_2$, and the winding angles on the current-carrying roll and the opposite backup roll are $\theta_1$ and $\theta_2$, respectively, the following equation is obtained from $\rho_1=\rho_2$ and equation (2).

$$\frac{L_1}{2} + K \cdot \frac{1}{\theta_1^{0.28}} = \frac{L_2}{2} + K \cdot \frac{1}{\theta_2^{0.28}}$$

wherein $$K = 2t \cdot \frac{215.6}{1 + (\sigma_T / 2\sigma_e)} \therefore \frac{1}{\theta_2^{0.28}} = \frac{L_1 - L_2}{2K} + \frac{1}{\theta_1^{0.28}} \quad (3)$$

$\theta_1$ is determined by the hardness of the current-carrying roll and the backup roll or the pressure of the rolls. If the nip width a between the current-carrying roll and the backup roll is measured, the following equation is established:

$$a=(L_1\theta_1)/2 \quad (4)$$

On the other hand, with respect to $\theta_2$, when the offset amount d is extremely smaller than the diameter of the backup roll, since the offset amount d can be considered substantially equal to the nip width between the backup roll and the steel strip, the following equation is obtained:

$$d=(L_2\theta_2)/2 \quad (5)$$

Rearrangement of Equation (3) by substituting equations (4) and (5) into equation (3) gives the following equation:

$$d = \left\{ \frac{L_1 - L_2}{2K} \left( \frac{2}{L_2} \right)^{0.28} + \left( \frac{1}{a} \cdot \frac{L_1}{L_2} \right)^{0.28} \right\}^{-1/0.28} \quad (1)$$

wherein $$K = 2t \cdot \frac{215.6}{1 + (\sigma_T / 2\sigma_e)}$$

In the present invention, since the offset amount required for making warpage of the steel strip zero is computed according to equation (1), and the steel strip is previously offset before working, it is possible to stably pass the steel strip and correct warpage thereof.

REFERENCE NUMERALS

1 current-carrying roll, 2 backup roll, 3 upper electrode, 4 lower electrode, 5 steel strip, 6 movement direction, 11 shifter, 12 arithmetic device, 13 data, 14 input, 15 output

BEST MODE FOR CARRYING OUT THE INVENTION

In the present invention, setting the offset amount between a current-carrying roll and an opposite backup roll within the range of 5 to 35 mm makes it possible to maintain the pressure between the current-carrying roll and the backup roll at a constant value, and prevent the occurrence of spark between the current-carrying roll and a steel strip. Also, by setting the offset amount to 35 mm or less, the vertical variation of the pass line of the steel strip can be suppressed to 2 mm or less, and no difference occurs between the deposits on the face and back of the steel strip. Also, by setting the offset amount between the current-carrying roll and the backup roll to 5 mm or more, and the diameter of the backup roll to be smaller than that of the current-carrying rolls, it is possible to improve the effect of correcting warpage of the steel strip.

Figure 1:
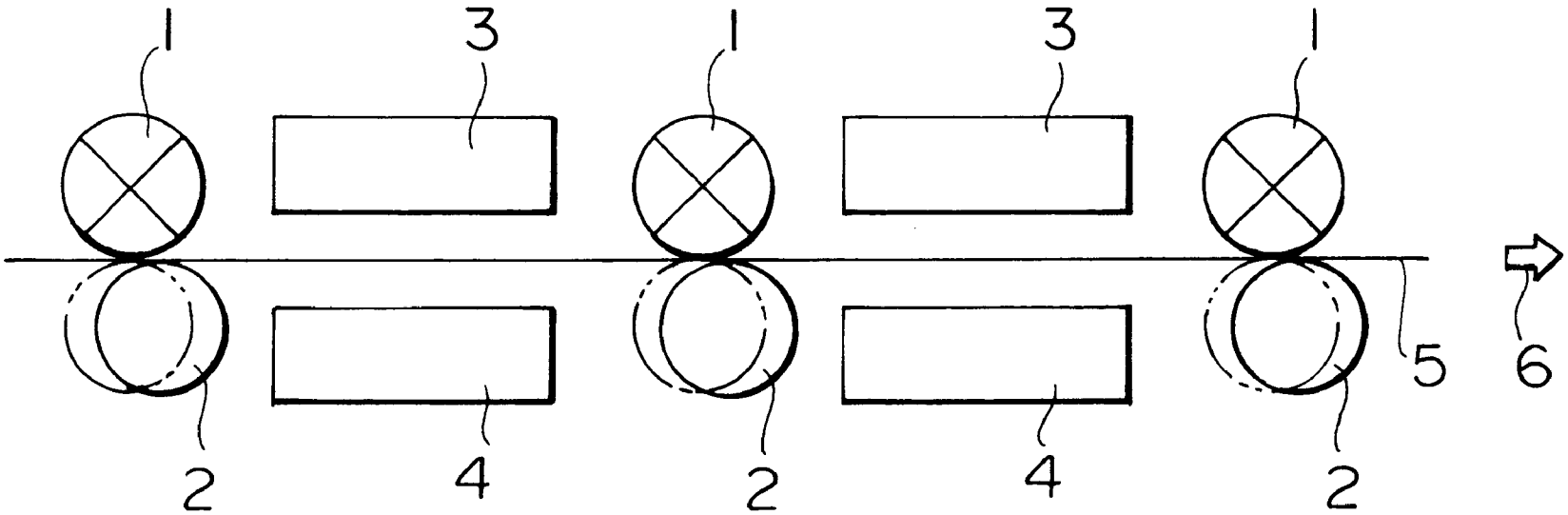
FIG. 1 A schematic drawing of a plating apparatus.

FIG. 1 is a schematic drawing of a horizontal plating apparatus in accordance with an embodiment of the invention. A steel strip 5 is moved in the movement direction 6. Current-carrying rolls 1 and backup rolls 2 are arranged to vertically hold the steel strip 5 therebetween, and upper electrodes 3 and lower electrodes 4 are disposed between the respective current-carrying rolls 1 so that the steel strip 5 is plated by flowing a plating solution between the electrodes 3 and 4, and passing a current.

Figure 2:
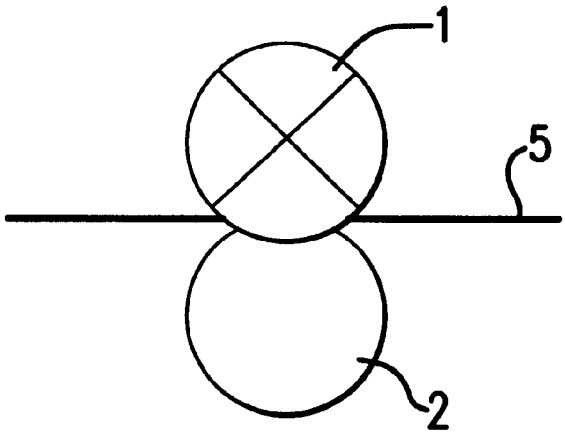
PRIOR ART FIG.2
FIG. 2 A drawing illustrating the relation between a conventional current-carrying roll and backup roll.

FIG. 2 is a drawing showing the arrangement of a conventional current-carrying roll 1 and backup roll 2. The current-carrying roll 1 and the backup roll 2 are disposed at the same position in the movement direction of the steel strip 5 to vertically hold the steel strip therebetween. Since the conductor roll 1 comprises an iron roll, while the backup roll 2 comprises a rubber roll, the backup roll 2 is depressed due to a difference in hardness, and the steel strip 5 is passed between the rolls, thereby bending the steel strip 5. The residual stress produced at this time is pulled by tensile force to cause warpage in the steel strip in the width direction thereof.

Embodiment 1

Figure 3:
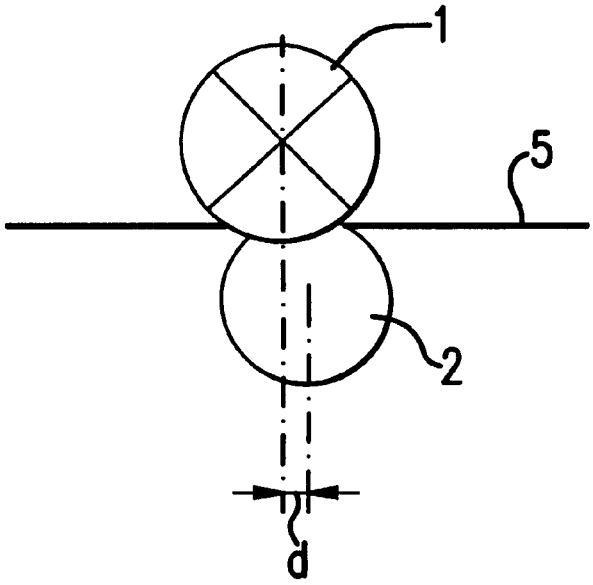
FIG. 3 A drawing illustrating the relation between a current-carrying roll and a backup roll of the present invention.

FIG. 3 is a drawing showing an embodiment of the present invention. This drawing shows a case where a backup roll 2 is offset relatively to a current-carrying roll 1 by an amount d in the movement direction of a steel strip 5. The same offset effect can also be achieved by moving the current-carrying roll 1 in the direction reverse to the movement direction of the steel strip, while the backup roll 2 is fixed. Although the steel strip 5 is bent due to a difference in hardness between the current-carrying roll 1 and the backup roll 2, the steel strip 5 contacts the backup roll 2 even after being passed through the current-carrying roll 1, and pulled by tensile force, thereby winding the steel strip 5 on the backup roll 2. Therefore, the steel strip 5 is bent by the backup roll 2 in the direction reverse to bending by the current-carrying roll 1, thereby relieving the residual stress produced by the current-carrying roll 1. At this time, when the offset amount d is increased, the amount of winding of the steel strip 5 on the backup roll 2 is increased, and the radius of curvature approaches the diameter of the backup roll 2, thereby increasing the warpage correcting effect. However, if the offset amount is increased, since the contact portion between the backup roll 2 and the current-carrying roll 1 is moved upward from the pass line, the vertical position of the steel strip 5 is also moved upward, and thus a difference occurs between the thicknesses of the deposits on the face and back of the steel strip. Therefore, the diameter of the backup roll 2 is made smaller than that of the current-carrying roll 1 to improve the warpage correcting effect, and the offset amount is minimized to suppress a rise of the pass line of the steel strip 5 to 2 mm or less.

Figure 4:
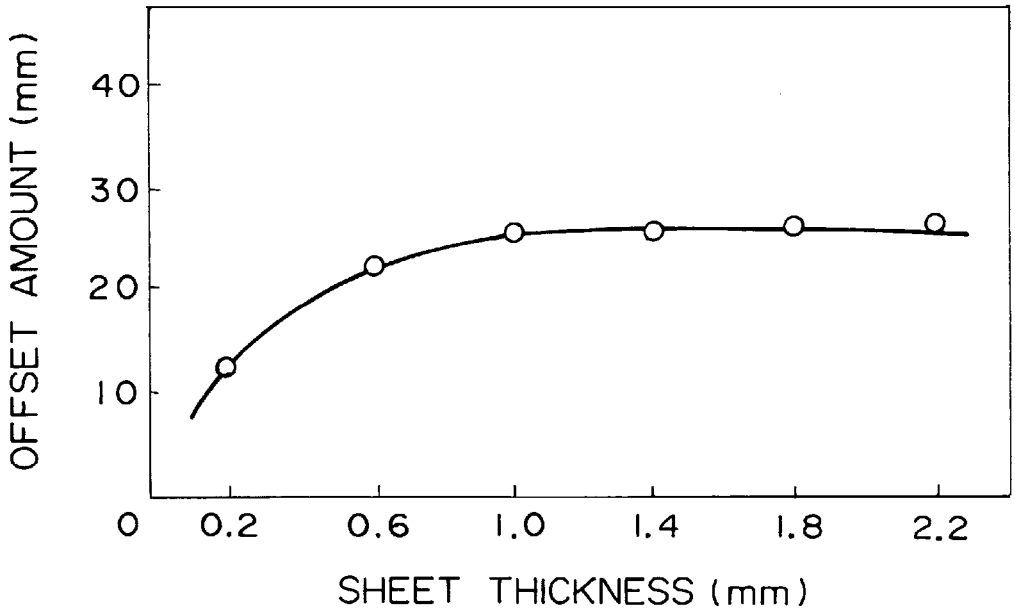
FIG. 4 A graph showing the relation between an offset amount required for making warpage zero and the sheet thickness.
Figure 5:
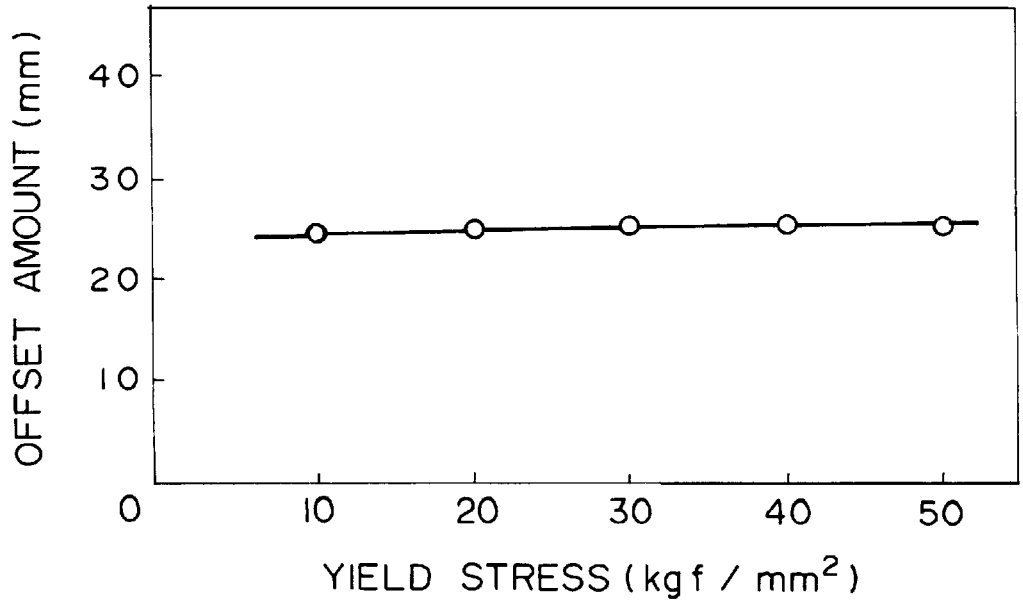
FIG. 5 A graph showing the relation between an offset amount required for making warpage zero and yield stress.
Figure 6:
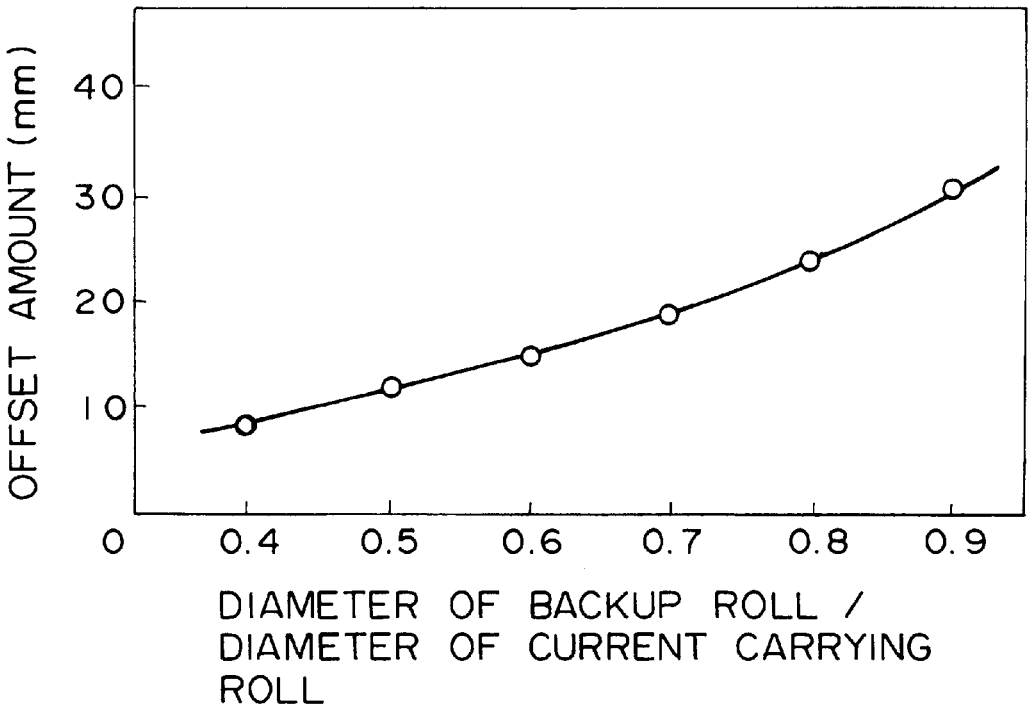
FIG. 6 A graph showing the relation between an offset amount required for making warpage zero and the diameter ratio of a backup roll to a current-carrying roll.

The offset amount is determined according to various factors. FIGS. 4, 5 and 6 show examples of the relations between the offset amount required for making warpage zero to the sheet thickness, yield stress and the backup roll diameter/current-carrying roll diameter, which were examined by changing these factors while fixing other factors, in comparison with general conditions in which the sheet thickness was 1.0 mm, yield stress was 16 kgf/mm$^2$, the current-carrying diameter was 375 mm, the nip width (a) between the current-carrying roll and the backup roll was 37.5 mm, and the tensile force of a sheet was 3 kgf/mm$^2$.

Figure 7:
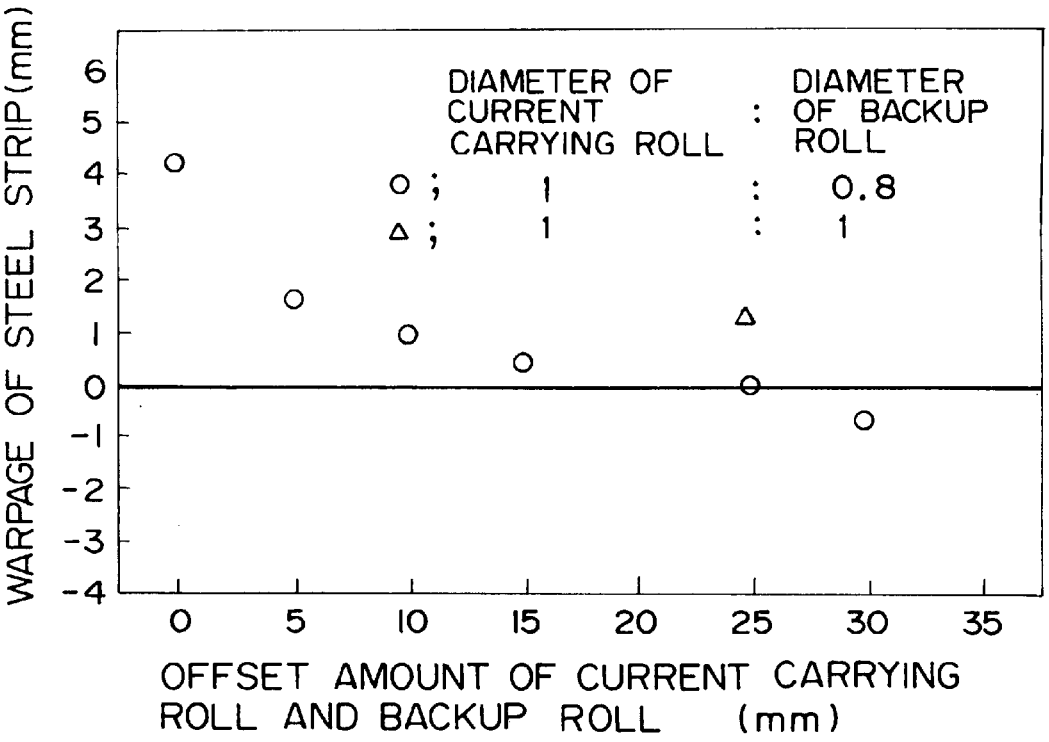
FIG. 7 A graph showing the results of measurement of warpage of a steel strip in a plating apparatus.

FIG. 7 is a graph showing the results of examination of the relation between widthwise warpage of the steel strip and the offset amount between the current-carrying roll and the backup roll under conditions in which the thickness was 1.0 mm, yield stress was 16 kgf/mm$^2$, the diameter of the current-carrying roll was 376 mm, the diameter of the backup roll was 300 mm, (current-carrying roll diameter): (backup roll diameter)=1:0.8, the dip width between the current-carrying roll and the backup roll was 37.5 mm, and the tensile force of the sheet was 3 kgf/mm$^2$. In the graph, ○ marks show the case where the diameter of the backup roll is 0.8D relative to the diameter D of the current-carrying roll. A marks show the case where the diameter of the backup roll is equal to the diameter of the current-carrying roll.

FIG. 7 indicates that, in this example, warpage of the steel strip can be zero by setting the offset amount to 24.3 m. The relation shown in FIG. 7 can previously be determined according to conditions of the steel strip, and the offset amount is properly previously set so that the warpage of the steel strip can be minimized.

Figure 8:
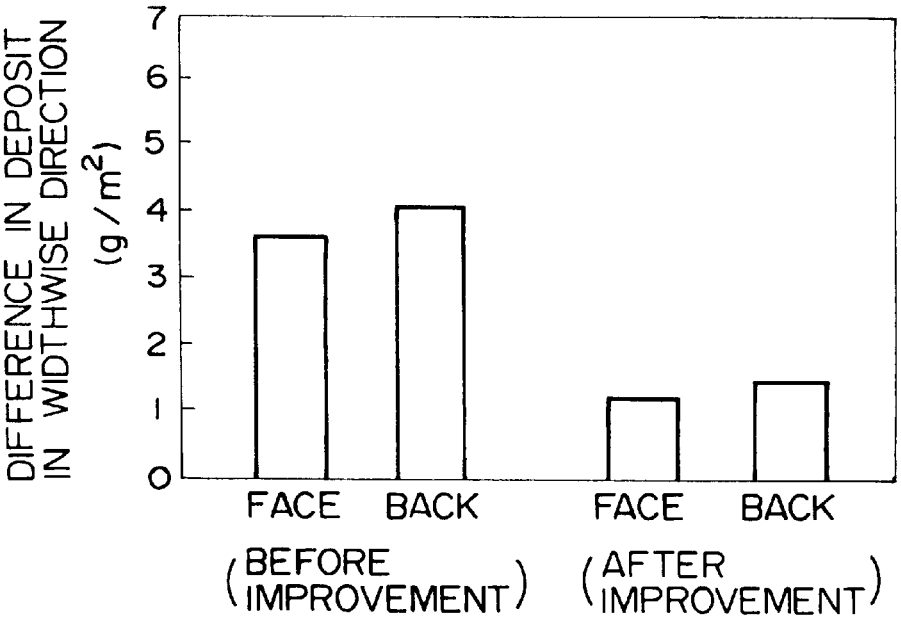
FIG. 8 A graph showing deposit distributions in the width direction before and after improvement.

In use of the apparatus shown in FIG. 1, when the diameter ratio of the backup roll to the current-carrying roll was set to 0.8, and the offset amount was set to 24.3 mm, deposit differences in the widthwise direction of the steel strip were determined before and after the backup rolls were offset. The results are shown in FIG. 8. By offsetting the backup rolls, the widthwise warpage of the steel strip was corrected, and the deposit difference in the widthwise direction could be decreased.

Embodiment 2

Figure 9:
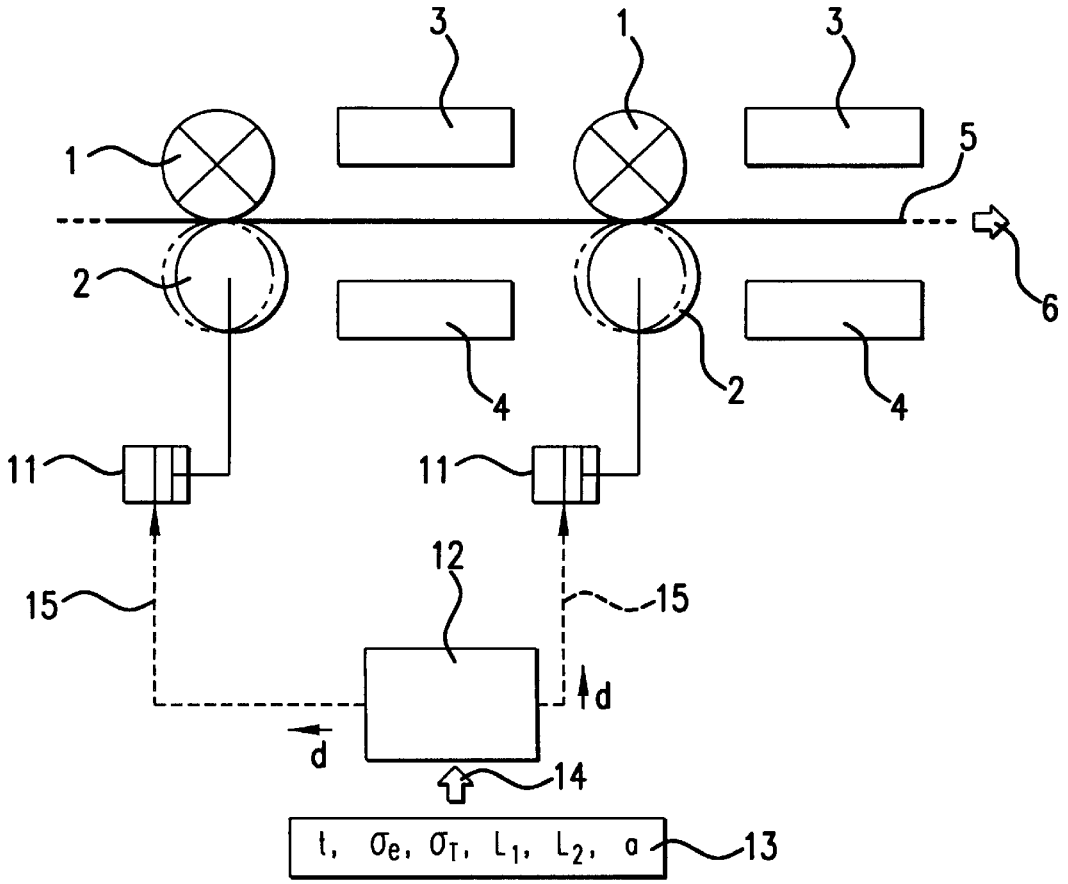
FIG. 9 A schematic drawing of a warpage correcting apparatus in accordance with an embodiment of the present invention.

FIG. 9 is a drawing showing an embodiment of the present invention. Reference numerals 1 to 6 denote the same as those shown in FIG. 1. Data 13 such as the thickness t of the steel strip, yield stress $\sigma_e$, tensile force $\sigma_T$, the current-carrying roll diameter $L_1$, the backup roll diameter $L_2$, and the nip pressure a between both rolls are input 14 to an arithmetic device 12 to compute the optimum offset d by the arithmetic device 12 according to the above equation (1), and the output 15 is output to shifters 11 for shifting the backup rolls 2. The shifters 11 receive the output 15 when a joint material is passed before the steel strip is passed to shift the backup rolls by the offset amount d, and then the steel strip is passed and plated. Therefore, the steel strip can be passed while maintaining the pressure on the steel strip, and there is thus no possibility that spark flaws occur due to the inferior contact between the steel strip and the current-carrying rolls. Since the backup rolls have previously been shifted before the steel strip is passed, warpage of the steel strip can be corrected over the whole length thereof.

Figure 10:
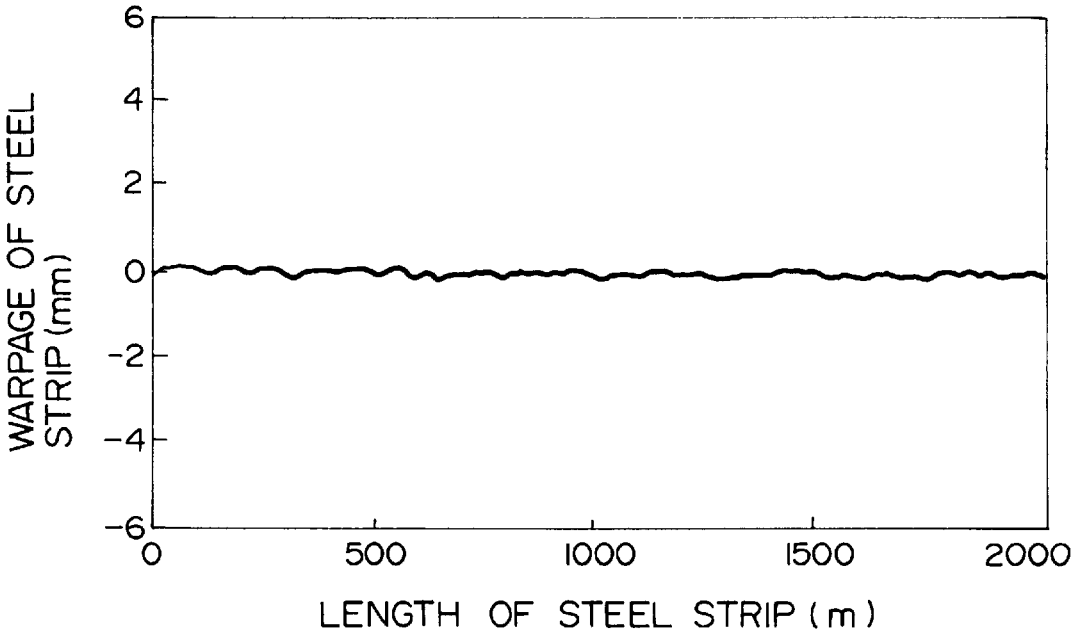
FIG. 10 A graph showing the results of measurement of warpage of a steel strip in the lengthwise direction thereof as an example of the effect of the present invention.
Figure 11:
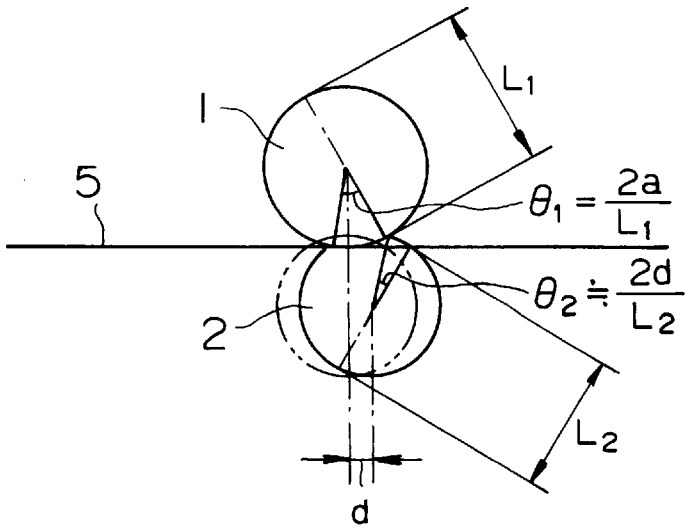
FIG. 11 A drawing showing the principle of correction of warpage of a steel strip by offset.

FIG. 10 is a graph showing the results of measurement of lengthwise warpage of the steel strip in accordance with the method of the present invention. The optimum offset amount determined according to Equation (1) using the thickness t of the steel strip=1.0 (mm), yield stress $\sigma_e$ of the steel strip=16 (kgf/mm$^2$), tensile force T=3.0 (kgf/mm$^2$), the current-carrying roll diameter $L_1$=375 (mm), the backup roll diameter $L_2$=300 (mm), and the nip width a between the current-carrying roll and the backup roll=37.5 (mm) is d=24.3 (mm). Therefore, as a result of offset by this amount, and measurement of warpage of the steel strip over the whole length thereof, the warpage of the steel strip could be substantially zero over the whole length thereof, as shown in FIG. 10. At the same time, in plating by passing a current of 10000 A through the current-carrying rolls, occurrence of spark flaws due to the inferior contact between the rolls was not observed.

INDUSTRIAL APPLICABILITY

In the present invention, by offsetting a current-carrying roll or an opposite backup roll by an offset amount within the range of 5 to 35 mm and fixing the rolls, it is possible to keep the pressure on the backup roll constant, prevent the occurrence of spark flaws and minimize widthwise warpage of the steel strip.

Also, by making the diameter of the backup roll smaller than that of an opposite current-carrying roll, it is possible to improve the effect of correcting warpage of the steel strip, decrease the offset amount between the current-carrying roll and the backup roll, decrease the vertical variation of the pass line of the steel strip, and decrease differences between the deposits on the face and back of the steel strip and in the widthwise direction thereof.

In the present invention, the offset amount required for making zero warpage of the steel strip is computed from the thickness of the steel strip, yield stress, tensile force, the current-carrying roll diameter, the backup roll diameter, and the nip width between both rolls, and either of the current-carrying roll or the backup roll have previously been shifted before the steel strip is passed and plated so that warpage of the steel strip can be corrected without the occurrence of spark flaws due to the inferior contact between the steel strip and the current-carrying roll. Also, since the roll is previously offset, there is the effect of correcting warpage of the steel strip over the whole length thereof.

What is claimed is:

1. A method of correcting warpage of a steel strip in a horizontal electroplating line comprising current-carrying rolls and backup rolls with the steel strip held therebetween, the method comprising the steps of:

providing at least one backup roll so that the backup roll is smaller than a current-carrying roll opposite to the backup roll; and prior to electroplating the steel strip, arranging the rolls so that the backup roll is offset relative to the current-carrying roll opposite to the backup roll in the movement direction of the steel strip, wherein the offset amount is determined prior to electroplating the steel strip according to the following equation:

$$d = \left\{ \frac{L_1 - L_2}{2K} \left( \frac{2}{L_2} \right)^{0.28} + \left( \frac{1}{a} \cdot \frac{L_1}{L_2} \right)^{0.28} \right\}^{-1/0.28}$$

wherein $$K = 2t \cdot \frac{215.6}{1 + (\sigma_T / 2\sigma_e)}$$

d: offset amount t: thickness of the steel strip passed (mm)

$\sigma_T$: tensile force of the steel strip passed (kgf/mm$^2$)

$\sigma_e$: yield stress of the steel strip passed (kgf/mm$^2$)

$L_1$: diameter of the current-carrying roll (mm)

$L_2$: diameter of the backup roll (mm)

a: constant, the value determined by the hardness and pressure of the current-carrying roll and the backup roll opposite to the current carrying roll, thereof.

* * * * *